US008360428B2

(12) United States Patent
Nakamura et al.

(10) Patent No.: US 8,360,428 B2
(45) Date of Patent: Jan. 29, 2013

(54) PRINT CONTROL APPARATUS AND PRINT CONTROL METHOD

(75) Inventors: Sho Nakamura, Yokohama (JP); Koji Okabe, Tokyo (JP); Kazuo Uetsuke, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 12/960,408

(22) Filed: Dec. 3, 2010

(65) Prior Publication Data

US 2011/0210508 A1 Sep. 1, 2011

(30) Foreign Application Priority Data

Feb. 26, 2010 (JP) ..... 2010-041659

(51) Int. Cl.
*B65H 39/10* (2006.01)

(52) U.S. Cl. ..... 271/298

(58) Field of Classification Search ..... 271/298
See application file for complete search history.

(56) References Cited

U.S. PATENT DOCUMENTS 5,284,339 A * 2/1994 van Opstal et al. ..... 271/288
5,777,882 A * 7/1998 Salgado ..... 700/214
5,957,450 A * 9/1999 Kida et al. ..... 271/291
6,272,297 B1 * 8/2001 Kobayashi ..... 399/82
8,040,535 B2 * 10/2011 Kurahashi et al. ..... 358/1.12
2004/0178572 A1 * 9/2004 Nishimura et al. ..... 271/298
2008/0042342 A1 * 2/2008 Tominaga et al. ..... 271/298
2010/0320679 A1 * 12/2010 Miyake et al. ..... 271/298

FOREIGN PATENT DOCUMENTS

JP 8-26586 A 1/1996

* cited by examiner

*Primary Examiner* — Kaitlin Joerger
*Assistant Examiner* — Prasad V. Gokhale
(74) *Attorney, Agent, or Firm* — Canon USA, Inc., IP Division

(57) ABSTRACT

When printing is to be executed on the basis of an input print job, and a group of sheets having undergone the printing on the basis of the input print job are discharged to a first one of multiple discharging destinations, the first discharging destination is switched to a second discharging destination in the course of the discharging process, and the second discharging destination is selected in accordance with an arranged order of the group of sheets.

8 Claims, 3 Drawing Sheets

PRINT CONTROL APPARATUS AND PRINT CONTROL METHOD

BACKGROUND OF THE INVENTION

1. Field of the Invention

The present invention relates to print control apparatuses and print control methods that can discharge printed sheets to multiple discharging destinations.

2. Description of the Related Art

When performing printing of multiple copies, an apparatus that discharges sheets to different discharging destinations (trays) for each copy is known (see Japanese Patent Laid-Open No. 8-26586). In Japanese Patent Laid-Open No. 8-26586, multiple adjoining trays are allocated to a single job in advance so that sheets are discharged to the adjoining trays for each copy, thereby preventing the sheets from being mixed with those that correspond to another job.

In Japanese Patent Laid-Open No. 8-26586, if the number of output sheets corresponding to each copy exceeds the number of sheets that can be discharged to each tray, the remaining sheets are discharged to another available tray at that point. When discharging printed sheets to a discharging destination, the sheets are discharged facing upward or facing downward. When discharging the sheets facing upward, the discharging operation starts from the last page and ends by discharging the first page with its image facing upward. In contrast, when discharging the sheets facing downward, the discharging operation starts from the first page with its image facing downward and ends by discharging the last page facing downward.

If the number of output sheets corresponding to each copy exceeds the number of sheets that can be discharged to each tray, a user needs to collect the discharged sheets from different trays and gather the sheets to form a sheet bundle. However, in the related art, the trays that are to be used are not selected in view of the fact that the sheets would ultimately be collected by the user. Specifically, although the arranged order of the sheets differs between when the sheets are to be discharged facing upward and when the sheets are to be discharged facing downward, the selection of the trays is not implemented in view of whether the sheets are to be discharged facing upward or downward. This results in a complicated process for the user since the user needs to collect the sheets while checking the arranged order thereof.

SUMMARY OF THE INVENTION

One aspect of the present invention provides a print control apparatus and a print control method that solve the aforementioned problem. Another aspect of the present invention provides a print control apparatus and a print control method that allow for a facilitated sheet collecting process even when a group of sequential sheets are discharged dividedly to multiple discharging destinations.

Further features of the present invention will become apparent from the following description of exemplary embodiments with reference to the attached drawings.

DESCRIPTION OF THE EMBODIMENTS

An embodiment of the present invention will be described below with reference to the drawings. The relative positions and the shapes of components included in an apparatus used in this embodiment are merely examples and are not limited thereto.

Figure 1:
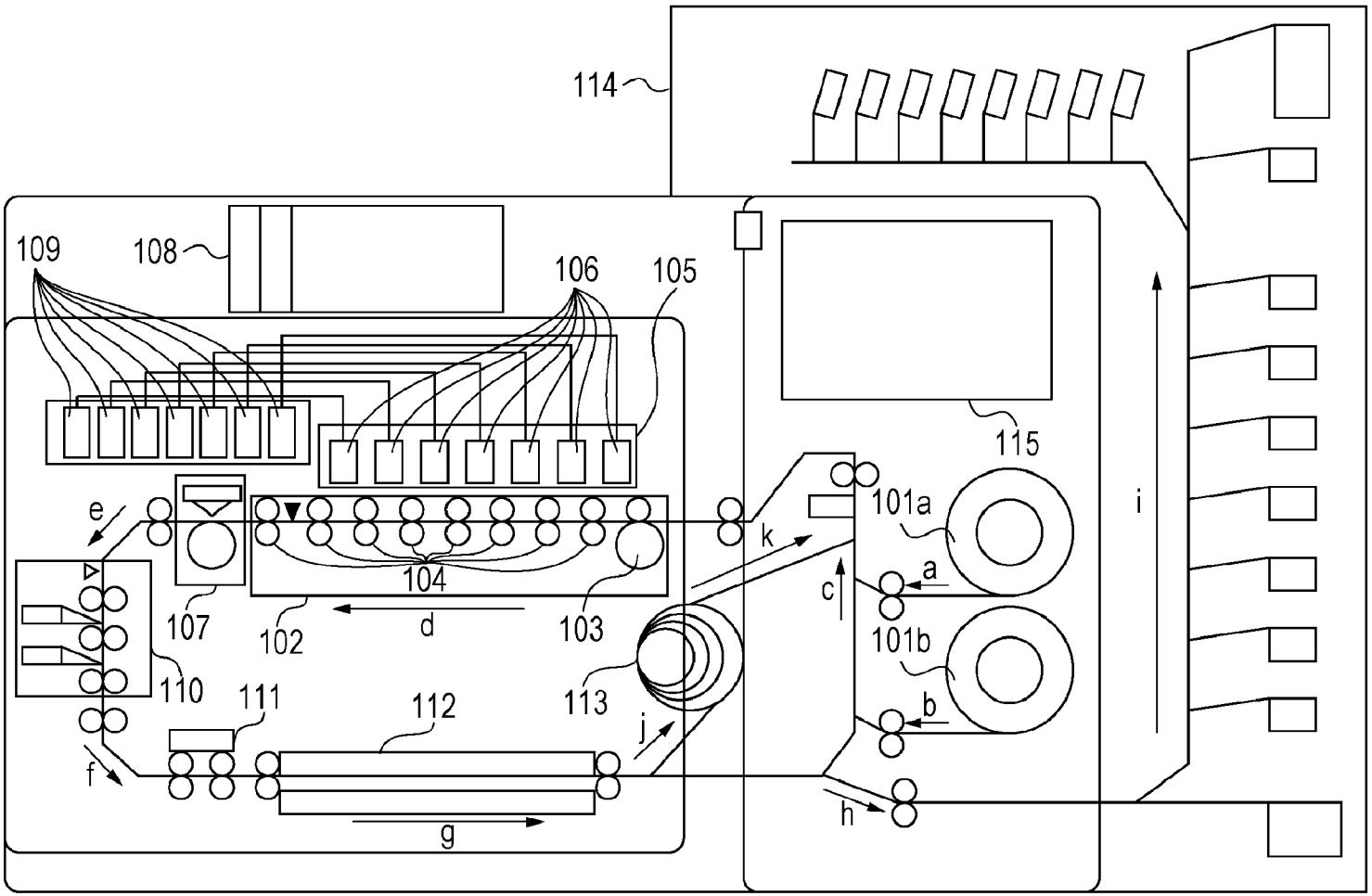
FIG. 1 illustrates the configuration of an image forming apparatus which is an example of an embodiment of the present invention.

FIG. 1 illustrates the schematic configuration of an image forming apparatus serving as an example of a print control apparatus according to this embodiment. Although the image forming apparatus in FIG. 1 only has a printing function for printing data received from an external apparatus, the image forming apparatus is not limited and may additionally include a reading device that reads an image from an original document so as to function as a photocopier, or may serve as a multifunction apparatus having other additional functions.

The following description is directed to an example where a roll sheet is used as a recording medium (i.e., a recording material or a recording sheet) on which printing is to be performed. Although this roll sheet is an example of a continuous sheet, a long continuous sheet of a type other than a roll type may be used. The continuous sheet may be cut automatically by the image forming apparatus or may be cut in response to a manual command by a user. The material of the recording medium is not limited to paper, but may be of various kinds so long as printing can be performed thereon. Furthermore, in addition to performing printing on a continuous sheet, the image forming apparatus may be capable of performing printing on a cut sheet that is cut in advance to a predetermined size.

The printing method employed in this embodiment is not limited to an inkjet method that uses liquid ink for printing an image, to be described below. For example, solid ink may be used as a recording agent to be applied onto the recording medium, and various kinds of methods may be employed, including an electrophotographic method using toner, a sublimation method, a thermal transfer method, and a dot impact method. Furthermore, this embodiment is not limited to a type that performs color printing using recording agents of multiple colors, but may be configured to perform monochrome printing using a black recording agent (including a grey recording agent) alone. Moreover, the printing performed in this embodiment is not limited to printing of a visible image, but may include printing of an invisible or low-visibility image or printing of various objects other than a typical image, such as a wiring pattern, a physical pattern used when manufacturing a component, or a DNA base sequence. In other words, this embodiment is applicable to various types of recording apparatuses so long as the recording agent or recording agents can be applied to the recording medium. If printing operation in the image forming apparatus in FIG. 1 is to be controlled on the basis of a command from an external apparatus connected to the image forming apparatus, the external apparatus serves as the print control apparatus.

FIG. 1 is a cross-sectional view schematically illustrating the overall configuration of the image forming apparatus that uses the roll sheet (i.e., a continuous sheet with a length, in the conveying direction, greater than a unit printing length (equivalent to one page)) as a recording medium. The image forming apparatus includes the following components 101 to 115, which are disposed within a single housing. However, these components may be disposed separately in multiple housings.

A control unit 108 contains a control portion including a controller (including a CPU or an MPU), an output unit for outputting user-interface information (e.g., a generator for generating display information and sound information), and various I/O interfaces, and is responsible for controlling the entire image forming apparatus.

The image forming apparatus includes an upper sheet cassette 101*a* and a lower sheet cassette 101*b* each provided for holding and feeding a roll sheet. A user attaches each roll sheet (referred to as "sheet" hereinafter) onto a magazine and then loads the magazine into the image forming apparatus. The sheet fed from the upper sheet cassette 101*a* is conveyed in a direction indicated by an arrow a, whereas the sheet fed from the lower sheet cassette 101*b* is conveyed in a direction indicated by an arrow b. The sheet from either cassette travels in a direction indicated by an arrow c so as to reach a conveyor unit 102. During printing operation, the conveyor unit 102 conveys the sheet in a direction indicated by an arrow d (horizontal direction) by using multiple rotating rollers 104. When switching from one sheet cassette, from which the sheet is fed, to the other sheet cassette, the already-fed sheet is rewound to the current cassette and a new sheet to be fed is subsequently fed from the other cassette in which the new sheet is set.

A head unit 105 is disposed above the conveyor unit 102 and faces the conveyor unit 102. The head unit 105 holds independent print heads 106 for multiple colors (seven colors in this embodiment), which are arranged in the sheet conveying direction. In this embodiment, seven print heads 106 corresponding to seven colors, namely, cyan (C), magenta (M), yellow (Y), light cyan (LC), light magenta (LM), grey (G), and black (K), are provided. It is needless to say that colors other than these colors may be used, or any one or any combination of those colors may be used.

The image forming apparatus ejects ink from the print heads 106 in synchronization with the sheet conveying process performed by the conveyor unit 102 so as to form an image on the sheet. The print heads 106 are positioned such that ink ejection targets are not aligned with the rotating rollers 104. As an alternative to directly ejecting ink onto the sheet, the ink may be first applied onto an intermediate transfer member, and be subsequently applied onto the sheet so as to form an image thereon.

The conveyor unit 102, the head unit 105, and the print heads 106 constitute a unit for printing in this embodiment.

Ink tanks 109 are provided for independently storing the inks of the respective colors. The inks in the ink tanks 109 are supplied via tubes to sub-tanks provided in correspondence to the respective colors. From the sub-tanks, the inks are supplied to the respective print heads 106 via tubes. The print heads 106 include line heads for the respective colors (seven colors in this embodiment) that are arranged in the conveying direction d. The line head for each color may be formed of a single seamless nozzle chip or may be formed of multiple segmented nozzle chips that are orderly arranged in a single line or in a zigzag pattern. This embodiment uses a so-called full multi-head having nozzles arranged in an area that covers the width of a print region of a maximum-size sheet that can be used in the image forming apparatus. Examples that can be employed as an inkjet method, in which ink is ejected from nozzles, include a method that uses a heat-generating element, a method that uses a piezo-element, a method that uses an electrostatic element, and a method that uses an MEMS element. With regard to the ejection of ink from the nozzles in each head based on print data, the ejection timing is determined on the basis of an output signal from a conveyance encoder 103.

After the image is formed on the sheet, the sheet is conveyed from the conveyor unit 102 to a scanner unit 107. The scanner unit 107 is configured to check whether there is a problem in the image printed on the sheet by optically reading the printed image or a specific pattern on the sheet, and also to check the conditions of the apparatus, including the ink ejection condition. Examples of methods used for checking the printed image include a method of checking the ink ejection condition by reading a pattern used for checking the condition of the heads, and a method of checking whether the printing operation is successful or not by comparing the printed image with the original image. An appropriate checking method can be selected from various kinds of methods.

The sheet is conveyed in a direction indicated by an arrow e from near the scanner unit 107 so as to be guided to a cutter unit 110. In the cutter unit 110, the sheet is cut into segments of a predetermined unit printing length. This predetermined unit printing length varies depending on the size of an image to be printed. For example, an L-size photograph has a length of 135 mm in the conveying direction, whereas an A4-size sheet has a length of 297 mm in the conveying direction. In the case of simplex printing, the cutter unit 110 cuts the sheet on a page-by-page basis, but sometimes does not cut the sheet on a page-by-page basis depending on the content of a print job. Furthermore, in the case of duplex printing, images are continuously printed on a first face (i.e., a face that undergoes printing first, such as a front face) of the sheet until reaching a predetermined length without the cutter unit 110 cutting the sheet on a page-by-page basis, and the cutter unit 110 cuts the sheet on a page-by-page basis if printing is performed on a second face (i.e., a face that undergoes subsequent printing, such as a reverse face). The cutter unit 110 is not limited to a type that cuts the sheet after every image during simplex printing, or during the printing performed on the second face in the case of duplex printing. Alternatively, the sheet may be kept uncut until reaching a predetermined length, and may be cut for each image (equivalent to a single page) by manual operation using a separate cutter. If it is necessary to cut the sheet in the width direction thereof, another cutter is used for cutting the sheet.

The sheet conveyed from the cutter unit 110 is conveyed in a direction indicated by an arrow f within the unit so as to be conveyed to a reverse-face printing unit 111. The reverse-face printing unit 111 is configured to print predetermined information onto the reverse face of the sheet when an image is to be printed only on the front face of the sheet. Examples of information to be printed on the reverse face of the sheet include characters, symbols, and codes that correspond to each printed image (such as a number used for order control). When the print heads 106 print an image for a print job corresponding to duplex printing, the reverse-face printing unit 111 prints the aforementioned information in an area other than the area in which the print heads 106 print the image. The reverse-face printing unit 111 may print the aforementioned information by employing a recording-agent imprinting method, a thermal transfer method, or an inkjet method.

The sheet traveling through the reverse-face printing unit 111 is subsequently conveyed to a dryer unit 112. The dryer unit 112 is configured to heat the sheet traveling in a direction indicated by an arrow g within the unit by using warm air (heated gas (air)) so as to dry the sheet, with the ink applied thereon, within a short time. Various techniques that can be employed as an alternative to using warm air for drying the sheet include using cool air, heating using a heater, leaving the sheet to air-dry, and radiating the sheet with electromagnetic waves, such as ultraviolet light. The sheets each cut to the unit printing length travel one by one through the dryer unit 112 and are conveyed in a direction indicated by an arrow h to a sorting unit 114.

The sorting unit 114 holds multiple trays (18 trays in this embodiment) and designates the tray to which the sheets are to be discharged in accordance with the unit printing length. Each tray is given a tray number. In the sorting unit 114, each sheet traveling in a direction indicated by an arrow i within the unit is discharged to one of the trays corresponding to a tray number set for each printed image while using a sensor provided on each tray to check whether there is space on the tray or whether the tray is fully stacked with sheets. Regarding the tray acting as a discharging destination for each cut sheet, the tray can be specifically designated by the original sender (i.e., host apparatus) of the print job, or any one of the available trays can be freely designated by the image forming apparatus. Each tray is capable of receiving a preset number of sheets. In the case of a print job that exceeds this preset number of sheets, the sheets are discharged to multiple trays. The number, the size, and the type of sheets that can be discharged to each tray vary depending on the size (type) of the tray. In FIG. 1, a group of trays (referred to as "large trays" hereinafter) arranged in the vertical direction are capable of receiving both large-size sheets (larger than A4-size and L-size sheets) and small-size sheets (L-size sheets). On the other hand, a group of trays (referred to as "small trays" hereinafter) arranged in the horizontal direction are capable of receiving small-size sheets (L-size sheets) but not large-size sheets. The large trays have a greater receivable number of output sheets than the small trays.

When sheet discharging operation is being performed or is completed, a display device (such as an LED) is used to notify the user of the status. For example, the trays may be provided with LEDs that emit different colors, and the user can be notified of the status of each tray on the basis of the color of a lit LED or whether the LED is glowing or blinking. The multiple trays can be given priority levels so that when the image forming apparatus executes a print job, available trays (without any sheets) are sequentially allocated as the sheet-discharging destinations in accordance with the priority levels. In a default setting, upper trays in the large tray group have higher priority than lower trays, and leftward trays in the small tray group have higher priority than rightward trays. Moreover, the large trays have higher priority than the small trays. The priority levels may be set in advance such that trays located where the user can easily remove the sheets therefrom have higher priority. Furthermore, the priority levels may be changeable where appropriate by user's operation.

A sheet winding unit 113 winds therearound a sheet having undergone printing on its front face without being cut for every page. When performing duplex printing, the sheet with images formed on the front face thereof is not cut on a page-by-page basis by the cutter unit 110 but is cut upon completion of continuous printing performed on the front face. The sheet having undergone printing on its front face travels in a direction indicated by an arrow j within the unit so as to be wound around the sheet winding unit 113. The sheet having images equivalent to a series of pages formed on the front face thereof and wound around the sheet winding unit 113 is turned over so that the face thereof opposite the front face becomes a printable face and is made to face the print heads 106. Then, the sheet is conveyed again in a direction indicated by an arrow k within the unit. By performing the conveying operation in this manner, images can be printed on the reverse face opposite the front face. In the case of normal simplex printing, the sheet with an image printed thereon is conveyed to the sorting unit 114 without being wound around the sheet winding unit 113.

Accordingly, during duplex printing, the sheet is wound around the sheet winding unit 113 so as to turn over the sheet and perform printing on the reverse face thereof. Therefore, the orientation of the faces of the sheet discharged toward the sorting unit 114 differs between simplex printing and duplex printing. Specifically, since the sheet is not turned over using the sheet winding unit 113 when performing simplex printing, the sheet with an image of a first page printed thereon is discharged in a state where the first-page image faces downward. In the case where a single print job corresponds to multiple pages, a sheet of the first page is discharged to a corresponding tray, and then sheets of subsequent pages are sequentially discharged to the tray and stacked on the first sheet. Such operation in which the sheets are stacked in an ascending order will be referred to as "face-down discharging operation" hereinafter. On the other hand, in the case of duplex printing, since the continuous sheet is turned over by using the sheet winding unit 113, a sheet with the image of the first page printed thereon is discharged in a state where the first-page image faces upward. In the case where a single print job corresponds to multiple pages, a sheet of the last page is discharged to a corresponding tray, and then sheets of preceding pages are sequentially discharged to the tray and stacked on the first sheet. Ultimately, a sheet with the first-page image printed thereon is discharged. Such operation in which the sheets are stacked in a descending order will be referred to as "face-up discharging operation" hereinafter. Alternatively, the printing order for the first face may be changed (i.e., to the descending order or the ascending order) between simplex printing and duplex printing so that the sheet face, when discharged, is oriented in the same direction (face-up or face-down) between simplex printing and duplex printing.

An operating unit 115 is provided for allowing the user to perform various kinds of operation as well as for informing the user of various kinds of information. For example, the operating unit 115 can be used for checking the print condition for each order, such as checking which tray a printed sheet with an image designated by the user is loaded on or checking whether the image is being printed or is completely printed. Furthermore, the operating unit 115 can also be used for checking various conditions of the apparatus, such as the remaining amount of ink and the remaining amount of sheet, as well as allowing the user to command maintenance of the apparatus, such as head cleaning.

Figure 2:
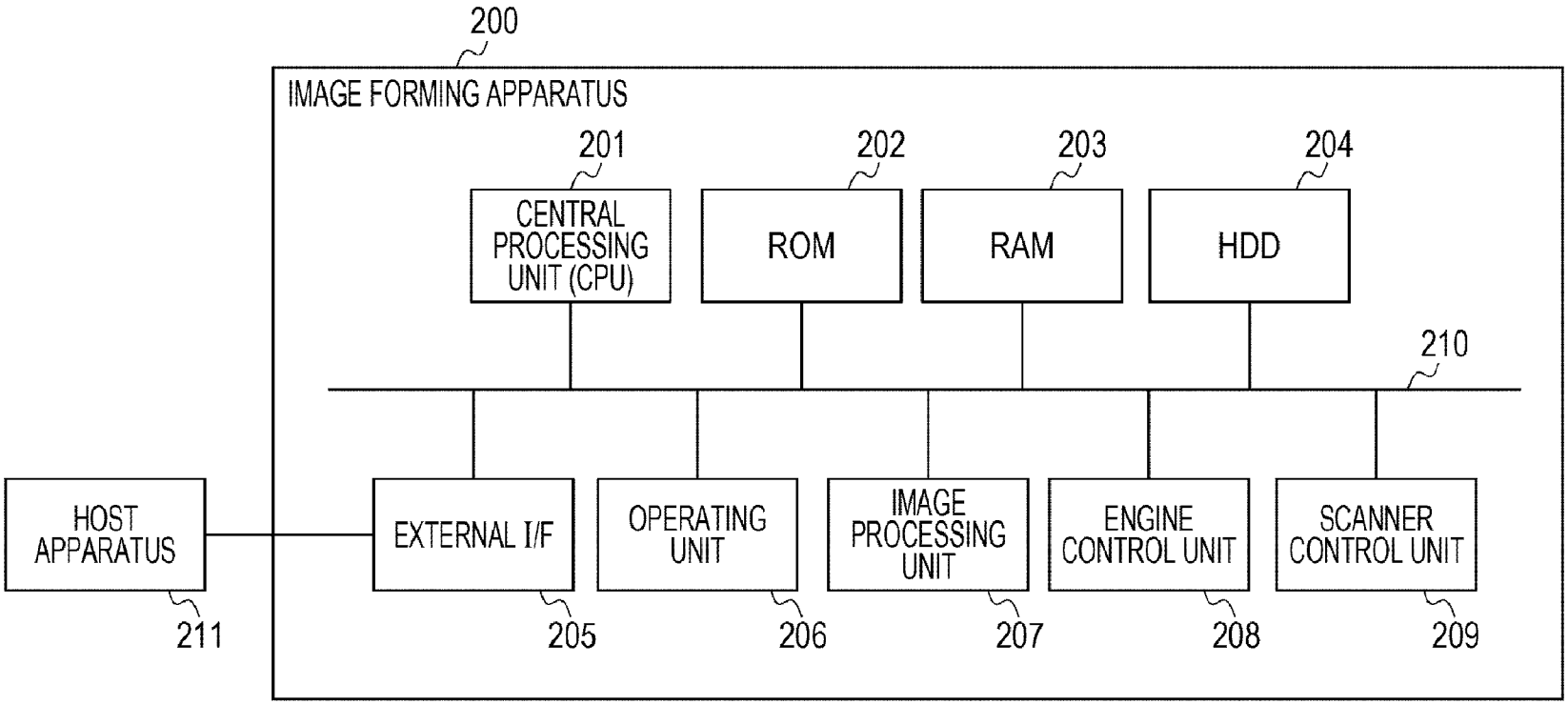
FIG. 2 is a block diagram illustrating the configuration related to controlling of the image forming apparatus shown in FIG. 1.

FIG. 2 is a block diagram illustrating the configuration related to controlling of the image forming apparatus shown in FIG. 1. An image forming apparatus 200 corresponds to the image forming apparatus shown in FIG. 1. It should be noted, however, that this configuration is an example, and various modifications are permissible.

A CPU 201, a ROM 202, a RAM 203, an image processing unit 207, an engine control unit 208, and a scanner control unit 209 are mainly included in the control unit 108. The control unit 108 is connected to an HDD 204, an operating unit 206, and an external I/F 205 via a system bus 210.

The CPU 201 is a central processing unit in the form of a microprocessor (microcomputer) and is included in the control unit 108 in FIG. 1. The CPU 201 executes programs and activates hardware so as to control the overall operation of the image forming apparatus 200. The ROM 202 stores the programs to be executed by the CPU 201 and fixed data necessary for various kinds of operation to be performed by the image forming apparatus 200. The RAM 203 is used as a work area by the CPU 201, is used as a temporary storage area for various kinds of received data, and is used for storing various kinds of setting data. The HDD 204 includes a built-in hard disk for storing and reading therefrom the programs to be executed by the CPU 201, print data, and setting information necessary for various kinds of operation to be performed by the image forming apparatus 200. An alternative mass storage device may be used in place of the HDD 204.

The operating unit 206 includes hard keys and a touch-screen for allowing the user to perform various kinds of operation, as well as a display section for presenting (informing) various kinds of information to the user. The operating unit 206 corresponds to the operating unit 115 in FIG. 1. The aforementioned information can also be presented to the user by outputting sound (such as a buzzer sound or an audio sound) based on sound information from an audio generator.

The image processing unit 207 is configured to render (convert) print data (such as data expressed with a page-description language) into image data (bit-mapped image) to be used in the image forming apparatus 200 and also to perform image processing. The image processing unit 207 converts the color space (e.g., YCbCr) of the image data included in the input print data into a standard RGB color space (e.g., sRGB). Where necessary, various kinds of image processing, such as resolution conversion to an effective number of pixels (printable by the image forming apparatus 200), image analysis, and image correction, are performed on the image data. The image data obtained as the result of the image processing is stored in the RAM 203 or the HDD 204.

The engine control unit 208 controls processing of printing the image onto the sheet on the basis of the print data in response to a control command received from the CPU 201. Specifically, the engine control unit 208 commands the print heads 106 for the respective colors to eject ink, sets the ejection timing for adjusting dot positions (i.e., ink landing positions) on the recording medium, and performs adjustment on the basis of an obtained drive state of the print heads 106. The engine control unit 208 performs drive control of the print heads 106 in accordance with the print data and makes the print heads 106 eject ink so as to form an image on the sheet. Furthermore, the engine control unit 208 performs control of conveying rollers, including sending a command for driving a feed roller that feeds the sheet from the corresponding cassette, sending a command for driving a conveying roller that conveys the fed sheet, and acquiring the rotating condition of the conveying roller, thereby stopping and conveying the sheet at an appropriate speed in an appropriate path.

The scanner control unit 209 controls an image sensor in response to a control command received from the CPU 201, reads the image from the sheet, acquires red (R), green (G), and blue (B) analog brightness data, and converts the analog brightness data into digital data. The image sensor may be, for example, a CCD image sensor or a CMOS image sensor. The image sensor may also be, for example, a linear image sensor or an area image sensor. The scanner control unit 209 sends a command for driving the image sensor, acquires the condition of the image sensor on the basis of the driving operation, analyzes the brightness data acquired from the image sensor, detects whether or not ink is ejected from the print heads 106, and detects a cut position of the sheet. If the sheet is determined by the scanner control unit 209 as having an image properly printed thereon, the sheet undergoes a process for drying the ink on the sheet before being discharged to a designated tray in the sorting unit 114.

A host apparatus 211 corresponds to the aforementioned external apparatus and is externally connected to the image forming apparatus 200. The host apparatus 211 serves as a supply source of image data for making the image forming apparatus 200 perform printing operation, and sends various print job orders.

The host apparatus 211 may be a general-purpose personal computer (PC) or other types of data supplying apparatuses. An example of such other types of data supplying apparatuses is an image capturing apparatus that generates image data by capturing an image. The image capturing apparatus may be, for example, a reader (scanner) that generates image data by reading an image from an original document, or a film scanner that generates image data by reading a negative film or a positive film. Other examples of image capturing apparatuses include a digital camera that generates digital image data by capturing a still image, and a digital video camera that generates moving image data by capturing a movie. Alternatively, photo storage may be set in a network, or a socket for inserting a detachable portable memory therein may be provided to the image forming apparatus 200 so that image data can be generated and printed by reading an image file stored in the photo storage or the portable memory. In place of a general-purpose PC, various types of data supplying apparatuses, such as a terminal dedicated to the image forming apparatus 200, may be used. The data supplying apparatus may be a component of the image forming apparatus 200 or may be an independent apparatus that is externally connected to the image forming apparatus 200. If the host apparatus 211 is a PC, an operating system (OS), application software that generates image data, and a printer driver for the image forming apparatus 200 are installed in a storage device in the PC. The printer driver controls the image forming apparatus 200 as well as generating print data by converting the image data supplied from the application software into a format that can be handled by the image forming apparatus 200. The conversion from the print data to the image data may be performed in the host apparatus 211 before the converted data is supplied to the image forming apparatus 200. It should be noted that the above-described processing does not necessarily need to be entirely performed in the software. The above-described processing may partly or entirely be performed using hardware, such as an application specific integrated circuit (ASIC). The image data and other commands supplied from the host apparatus 211, as well as a status signal, are exchangeable with the image forming apparatus 200 via the external I/F 205. The external I/F 205 may be a local I/F or a network I/F. The external I/F 205 may be connected in a wired or wireless manner.

The above-described components within the image forming apparatus 200 are connected and communicable with each other via the system bus 210.

Although a single CPU 201 is used to control all of the components in the image forming apparatus 200 in this embodiment shown in FIG. 2, an alternative configuration is permissible. Specifically, some of the functional blocks may each be provided with an additional CPU so as to be individually controlled by the respective CPUs. Furthermore, as an alternative to how the functional blocks are assigned in FIG. 2, the functional blocks may be divided as individual processors or controllers where appropriate, or some of the functional blocks may be integrated. Moreover, for reading data from the memory, a direct memory access controller (DMAC) may be used.

The flow of processing performed when the image forming apparatus 200 having the above configuration executes a print job will now be described. The following description relates to processing performed when executing a single print job corresponding to a single copy.

Figure 3:
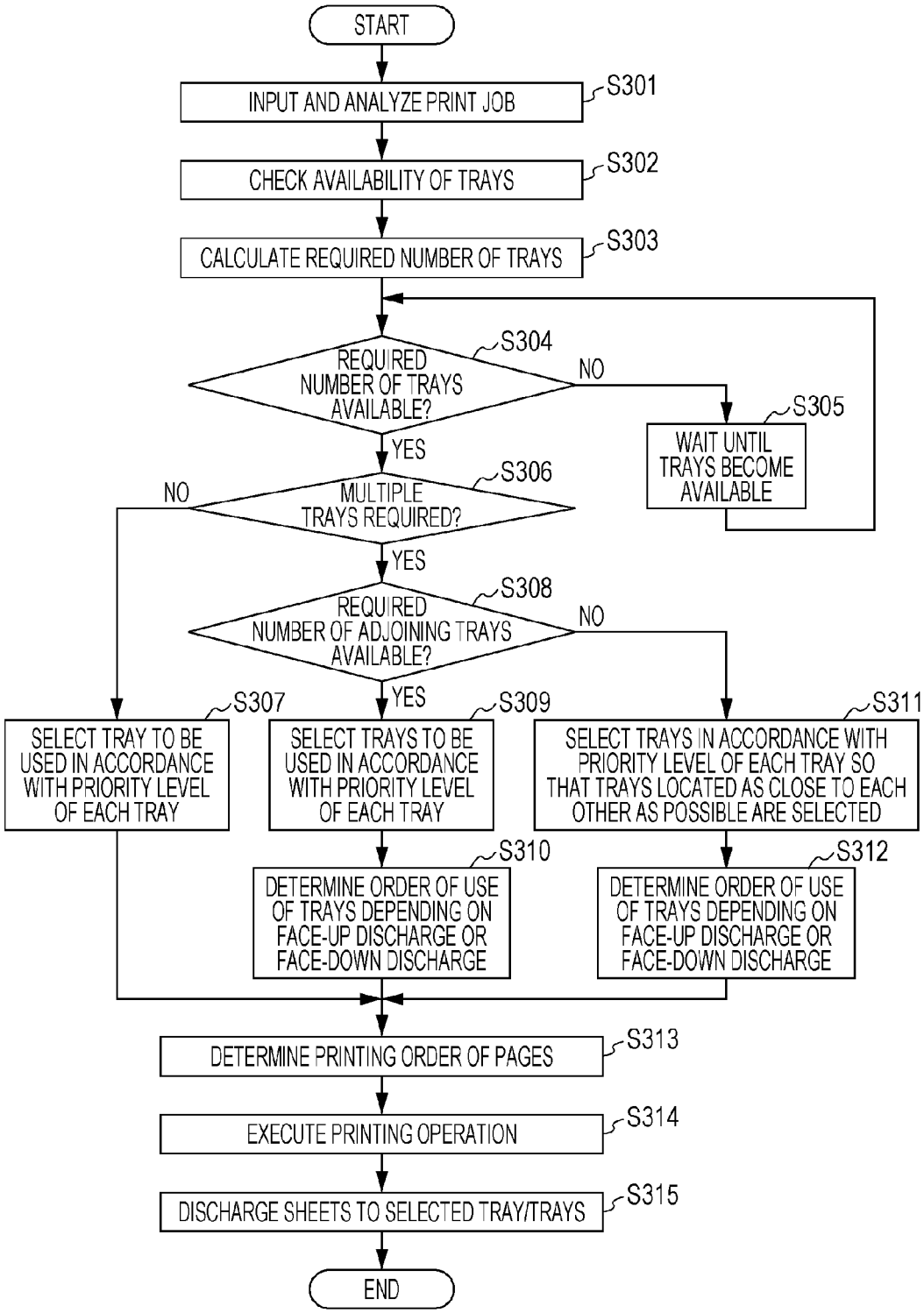
FIG. 3 is a flow chart illustrating the flow of processing performed when executing a print job.

FIG. 3 is a flow chart illustrating the flow of this processing. Specifically, in the flow shown in this flow chart, the CPU 201 performs the processing by loading a control program stored in the ROM 202 or the HDD 204 to the RAM 203 and then executing the control program.

First, in step S301, the image forming apparatus 200 receives a print job sent from the host apparatus 211. In addition to print data, the print job includes information indicating the print layout and information indicating the sheet size. Then, the CPU 201 analyzes the input print job. In this analysis, the sheet size and the number of output sheets are determined in accordance with the number of pages in the print data, the information indicating the print layout, and the information indicating the sheet size. Specifically, the determination is performed on the basis of, for example, whether the print layout corresponds to a layout in which images are to be disposed on both faces of a sheet, how many pages of images are to be disposed on each face of the sheet, what the required sheet size is in that case, and what the total number of pages is. The number of sheets to be output in printing operation of a single input print job determined by this analysis and the information of each sheet size are stored in the RAM 203. In this case, the number of output sheets indicates the number of output sheets to be cut by the cutter unit 110 and to be discharged to a corresponding tray.

In step S302, the CPU 201 checks for availability of a tray, among the trays in the sorting unit 114, usable for the printing operation based on the print job input in step S301. Specifically, since the sheet size is determined in the analysis in step S301, if the sheet size is a small size (L-size), all of the tray groups are checked for availability, whereas if the sheet size is a large size (i.e., larger than L-size), the large tray group is checked for availability. In this case, a tray currently having no sheets is determined as being an available tray on the basis of an output of the sensor provided on each tray. The determination result (i.e., the tray number of the available tray) is stored in the RAM 203.

In step S303, the CPU 201 calculates the number of trays required for discharging of sheets on which printing is to be performed on the basis of the print job input in step S301. In this case, the calculation procedure varies as follows, depending on the sheet size determined in step S301 and stored in the RAM 203.

If the sheet size determined in step S301 is a small-size, since all of the trays can be candidates, the required number of trays when using the large trays and the required number of trays when using the small trays are both calculated. If a single tray is required, whether the tray to be used is a large tray or a small tray, the small tray is given higher priority than the large tray. If a single large tray is required and multiple small trays are required, the large tray is given higher priority than the small trays. In the case where multiple trays are required when using the large trays and the small trays, if the required number of trays is the same between the large trays and the small trays, the small trays are given higher priority than the large trays. If the required number of trays is different between the large trays and the small trays, the large trays are given higher priority than the small trays. The priority levels in this case are set so that, when the large trays and the small trays have the same conditions, a possibility of clogging of subsequent print jobs for large-size sheets due to full small trays is reduced, and the sheets can be discharged to a minimum number of trays by priority, thereby saving time and effort for collecting the sheets.

On the other hand, if the sheet size is determined in step S301 as being a large-size, since only the large trays are candidates, only the required number of large trays is calculated.

The priority levels and the required number of trays calculated for each tray type in the above-described manner are stored in the RAM 203.

In step S304, it is determined whether the tray/trays corresponding to the number of trays calculated in step S303 is/are available on the basis of the determination result in step S302. If the trays are given priority levels, the determination process is performed starting from the trays with higher priority levels, and if there is no availability in the trays with higher priority levels, it is determined whether there is any availability in the trays with lower priority levels.

If it is determined in step S304 that there are no available trays, the processing proceeds to step S305 so as to wait until there is a required number of available trays. Specifically, a process of monitoring whether the already discharged sheets are removed from the tray/trays required in accordance with the calculation result in step S301 is performed, and the determination process in step S304 is repeated. During this time, if there is another print job that is executable (for example, if there is another print job that can be executed using a smaller number of trays), this print job may be executed first. If it is determined in step S304 that there is/are an available tray/trays, the processing proceeds to step S306 where it is determined whether multiple trays are required. The determination method in this case varies depending on the determination result in step S304. Specifically, the branch destination in step S306 varies depending on how many trays of which type are available.

If it is determined in step S306 that multiple trays are not required, the processing proceeds to step S307 where a single tray to be used in the current printing operation is selected in accordance with the priority level of each tray. The tray number of the selected tray is stored in the RAM 203, and the tray is reserved. In this case, the tray is selected in accordance with the priority levels given to the respective trays (described above with reference to FIG. 1), which is different from the priority levels set in step S304.

If it is determined in step S306 that multiple trays are required, the processing proceeds to step S308 where it is determined whether there are a required number of available adjoining trays. If there are a required number of available adjoining trays, the processing proceeds to step S309 where adjoining trays to be used are selected in accordance with the priority level of each tray. The tray number of each selected tray is stored in the RAM 203, and the tray is reserved. In this case, available trays are searched sequentially starting from the higher priority levels set for the trays. If there are available trays but not satisfying the required number of trays, these trays are skipped. When a required number of available adjoining trays are found, the trays are reserved. Then, in step S310, the order in which the multiple trays reserved in step S309 are to be used is determined. Specifically, if it is determined that printing is to be performed on both faces of the sheet in the analysis in step S301, since each printed sheet will be discharged facing upward, the aforementioned order is determined so that the sheets are discharged starting from upper-level trays. In this case, the upper-level trays refer to trays located at the upper levels in the case of the large trays, or trays located at the right side in the case of the small trays. On the other hand, if it is determined that printing is to be performed only on one side of the sheet, since each printed sheet will be discharged facing downward, the aforementioned order is determined so that the sheets are discharged starting from lower-level trays. Thus, by stacking a group of sheets discharged to multiple trays in an as-is manner, the user can obtain a group of sheets stacked in an appropriate order. The determination process of the aforementioned order can be simply performed in accordance with duplex printing or simplex printing, or may be performed depending on whether the sheets are to be discharged facing upward or downward. In either case, the discharging destinations may be selected so that, by simply stacking a group of sheets, ultimately discharged to different trays, in an as-is manner, a group of sheets stacked in a proper order can be obtained.

On the other hand, if it is determined in step S308 that a required number of adjoining trays are not available, the processing proceeds to step S311 where a required number of trays are selected in accordance with the priority levels of the trays such that the trays located as close to each other as possible are selected. The tray number of each selected tray is stored in the RAM 203. In this case, a combination in which the first tray to receive the sheets and the last tray to receive the sheets are separated from each other by the shortest distance is searched, and a tray group satisfying this condition is selected as a tray group to be used for the current printing operation. In step S312, the order in which the trays are to be used is determined depending on whether the sheets are to be discharged facing upward or downward, as in step S310.

In step S313, the printing order of pages is determined. If the print layout indicates that images are to be disposed on both faces of the sheet, the images to be printed first onto the first face are continuously printed, as described above. After printing all of the images onto the first face, a setting process is performed so that images to be disposed on the reverse face are printed thereon in a reverse order relative to the order used for the first face. If the print layout indicates that images are to be disposed only on one face of the sheet, a setting process is performed so that printing is performed in the order of input pages. Alternatively, the order of pages may be set in accordance with various kinds of print layouts, such as a print layout for bookbinding printing.

In step S314, the engine control unit 208 executes printing operation in the order of pages determined in step S313 in accordance with the print layout designated in the print job.

When performing duplex printing on the sheet, the following procedure is taken. Specifically, the CPU 201 temporarily stores the input print job into the HDD 204 and supplies the print data of each page to the image processing unit 207 in accordance with the order of pages determined in step S313.

The image processing unit 207 converts the print data into a printable format (renders the print data to image data), and stores the image data in the HDD 204. The generated image data is supplied to the engine control unit 208 in the aforementioned order of pages.

The engine control unit 208 receiving this image data feeds the sheet from the sheet cassette 101*a* or 101*b* in accordance with the size of the image to be printed. Then, the engine control unit 208 makes the conveyor unit 102 convey the sheet to a print position of the head unit 105, sequentially performs image printing based on the image data onto the first face, and conveys the sheet to a read position of the scanner unit 107. Then, each image is checked if it has been properly printed on the basis of the content of image data obtained by the scanner unit 107 reading the printed image, and the sheet is conveyed toward the cutter unit 110.

When it is confirmed that the image is properly printed, the sheet does not undergo cutting by the cutter unit 110 on a page-by-page basis, but travels through the dryer unit 112 in a state where the sheet on which the pages are printed onto the first face is not cut. After drying the ink on the sheet, the sheet is wound around the sheet winding unit 113. On the other hand, if it is confirmed that the image is not properly printed, the CPU 201 makes the cutter unit 110 cut the sheet so as to discharge the page with an improperly printed image. Then, the cut sheet is discharged to a tray (such as the lowermost tray), among the trays in the sorting unit 114, used for discharging rejects. Subsequently, the CPU 201 resupplies the image data to the engine control unit 208 so that printing is performed again for the improperly printed page. Then, the rest of the above-described processing is repeated.

When the printing operation on the first face is completed, printing operation on the reverse face is performed. The engine control unit 208 re-conveys the sheet, with the images printed on the first face thereof, wound around the sheet winding unit 113 toward the conveyor unit 102, and starts printing on the reverse face, starting from the last page. With regard to the printing performed on the reverse face of the sheet, the sheet from the sheet winding unit 113 is conveyed such that the leading edge of the sheet is the side thereof cut by the cutter unit 110, and the reverse face is made to face the head unit 105. When the sheet is conveyed to the print position of the head unit 105, the engine control unit 208 sequentially prints an image of each page based on a print command onto the reverse face at the underside of the corresponding image on the first face. Then, the scanner unit 107 checks whether the image has been properly printed in a manner similar to that for the first face. Furthermore, when performing printing on the reverse face, the sheet is cut by the cutter unit 110 for every output (on a page-by-page basis).

When printing is to be performed only on one face of the sheet, the printing is performed in a similar manner to the printing performed on the first face in duplex printing. However, the sheet is not wound around the sheet winding unit 113, but is cut by the cutter unit 110 for every output (on a page-by-page basis) during the printing performed on the first face.

Each sheet cut in step S314 is sequentially discharged in step S315 to the reserved tray/trays selected in step S307, S309, or S311. In this case, if the sheets are to be discharged to the trays reserved in step S309 or S311, the sheets are discharged on the basis of a discharge method (face-up or face-down) according to a print mode while switching the trays in the course of the discharging operation in accordance with the order determined in step S310 or S312. The switching of the trays is performed by changing the current tray number designated to the sorting unit 114 by the CPU 201 to a subsequent tray number after a group of sequential sheets reach the upper limit of the current tray.

The sorting unit 114 switches the sheet conveying path in accordance with the tray number designated by the CPU 201 so as to discharge the sheets to the tray corresponding to the designated tray number. The total number of sheets discharged in step S315 is equal to the number of output sheets analyzed in step S301.

The printing operation performed in step S314 and the sheet discharging operation performed in step S315 are sometimes performed concurrently. In the case where sheets corresponding to a single print job are discharged to multiple trays, the CPU 201 makes the LEDs provided in the trays to emit light of the same color so as to guide the user to remove the sheets from the trays. The emission of light from these LEDs may be performed when a job ID of the print job is designated via the operating unit 206 so that the discharging destinations can be readily identified. Furthermore, the CPU 201 makes the operating unit 206 display a notification that the sheets have been discharged to multiple trays together by using the job ID and the tray numbers. In this case, the order in which the sheets are to be removed from the trays (e.g., a first tray from which the sheets are to be removed first and a second tray from which the sheets are to be removed next) may be displayed so as to facilitate the removing process of the sheets. The notification by the emission of light from the LEDs and the notification by the display on the operating unit 206 are also performed when the sheets are entirely discharged to a single tray.

Furthermore, the notification by the emission of light from the LEDs and the notification by the display on the operating unit 206 can also be performed to allow the user to identify whether face-up discharging operation or face-down discharging operation is performed.

Furthermore, if the print layout designated in the print job is for bookbinding printing, and case-binding is used as a bookbinding method, an image of a front cover that externally wraps inner pages of printed matter is sometimes printed. In this case, the size of a sheet that is to become the front cover is twice as large as or is larger than the size of sheets that are to become the inner pages of printed matter. Therefore, in the case where the sheets constituting the inner pages of printed matter are to be discharged to a large tray, if the sheet forming the front cover can be discharged to the same tray, the sheet forming the front cover is first discharged to the tray, and the sheets constituting the inner pages of printed matter are subsequently discharged to the tray. Thus, the position of the leading edge of the group of sheets can be clearly identified on the basis of the position of the sheet forming the front cover. If the sheets constituting the inner pages of printed matter are to be discharged to a large tray but cannot be discharged to the same tray as that for the sheet forming the front cover, or if the sheets constituting the inner pages of printed matter are to be discharged to a small tray, the sheet forming the front cover is discharged to the uppermost tray among the large trays. Thus, the sheet forming the front cover can be distinguished from other inner pages of printed matter.

Although the printing operation is kept on hold until a required number of trays to be used in a single print job become available in the above embodiment, the present invention is not limited to this. For example, the printing operation may be commenced when at least one usable tray is available. In that case, the remaining sheets undergo printing and are discharged only when there is an available tray that can receive the remaining sheets in the correct arranged order of the sheets. Specifically, in the case of face-down discharging operation, the remaining sheets undergo printing and are discharged when an upper-level tray relative to a full tray already stacked with sheets becomes available. In the case of face-up discharging operation, the remaining sheets undergo printing and are discharged when a lower-level tray relative to a full tray already stacked with sheets becomes available.

Furthermore, although the sheets are discharged to another tray when the number of sheets discharged to a single tray exceeds a certain value in the above embodiment, the switching of the trays does not necessarily need to be performed when the number of discharged sheets reaches the upper limit of the current tray, but may be performed on the basis of a preset condition. Furthermore, a group of printed sheets to be discharged to multiple trays are not limited to a group of sheets corresponding to a single copy of a single print job, but portions of multiple copies may be discharged to different trays. Both cases are permissible so long as the arranged order of sheets is taken into account when the user collects the group of sheets.

Accordingly, with this embodiment, when printed sheets having undergone printing based on a print job are to be discharged to multiple destinations, the sheets are discharged to the trays in the order corresponding to the arranged order of the sheets, thereby facilitating the sheet collecting process for the user. Specifically, the user can obtain a sheet bundle in the properly arranged order by simply removing the sheets. In addition, since the print mode (sheet discharging method) is also taken into account, the group of sheets discharged to each tray are in the proper order whether face-up discharging operation or face-down discharging operation is performed. Specifically, the switching of trays is the opposite between face-up discharging operation and face-down discharging operation. In either case, the switching of trays is performed in accordance with the arranged order of the sheets.

Furthermore, when a group of sequential sheets are to be discharged to multiple trays, the multiple trays selected as discharging destinations are those located as close to each other as possible so that the efficiency for removing the sheets by the user can be improved. In this case, since the sheets are discharged to adjoining trays by priority, the process for removing the sheets from the trays becomes extremely easy for the user. Furthermore, even when there are no adjoining trays available, since the sheets are discharged to multiple trays located as close to each other as possible, the process for removing the sheets from the trays can be facilitated for the user. However, the trays do not necessarily need to be located as close to each other as possible. Simply using trays in the order corresponding to the arranged order of the sheets is sufficiently effective. Since a single tray is preferentially used if all of the sheets can be discharged to that tray, discharging of sheets to multiple trays can be prevented as much as possible. When performing bookbinding printing, since the sheet that is to become the front cover is discharged distinctively from the sheets that are to become the inner pages of printed matter, the front cover and the printed inner pages can be readily distinguished from each other when the user performs a bookbinding process.

Although the above description is directed to an example in which printing is performed on a roll sheet, the same procedure can be used when performing printing on a cut sheet.

Furthermore, in the above description, the maximum number of sheets that can be output to each tray may be set differently depending on the type of sheets. This is because the thickness can vary depending on the type of sheets.

In the above description, the processing excluding the printing operation but including the analysis of a print job and the selection of trays may be performed in an external apparatus, such as a host apparatus or an external controller, and the image forming apparatus may execute the printing operation on the basis of the analysis and the selection performed by the external apparatus. In this case, the external apparatus acquires the status (such as the status of the trays, as described above) from the image forming apparatus so as to select the trays to be used and determine the order in which the trays are to be used. In this case, the external apparatus functions as the print control apparatus.

The present invention can also be achieved by executing the following processing. Specifically, the processing involves loading a software program that has the functions described in the above embodiment into a system or an apparatus via a network or various kinds of storage media and making a computer (or a CPU or an MPU) of the system or the apparatus read and execute the program. The program may be executed by a single computer or may be executed by multiple computers in a cooperative manner. The aforementioned processing does not necessarily need to be performed entirely by the software program, but may be performed partly or entirely by hardware.

The present invention is not limited to the above-described embodiment, and various modifications (including application to other embodiments, combination with other embodiments) are permissible within the scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-041659 filed Feb. 26, 2010, which is hereby incorporated by reference herein in its entirety.

What is claimed is:

1. An apparatus comprising:

a first determining unit configured to determine whether a plurality of discharging destinations is to be used for discharging a group of sheets printed by a printing unit based on an input print job;

a second determining unit configured to determine, in response to the first determining unit determining that the plurality of discharging destinations is to be used, an order of use of the plurality of discharging destinations depending on whether a discharging operation is started from a former page of the group of sheets or a latter page of the group of sheets, wherein the second determining unit determines the order of use of the plurality of discharging destinations such that, in response to the discharging operation being started from the latter page of the group of sheets, an upper-level discharging destination of the discharging destinations is used in advance and that, in response to the discharging operation being started from the former page of the group of sheets, a lower-level discharging destination of the discharging destinations is used in advance; and at least one processor configured to perform functionality of at least one of the first determining unit and the second determining unit.

2. The apparatus according to claim 1, wherein the second determining unit determines the order of use of the plurality of discharging destinations depending on whether information, included in the input print job, indicates that the group of sheets is discharged facing upward or facing downward, wherein, in response to the information indicating that the group of sheets is discharged facing upward, the upper-level discharging destination of the discharging destinations is used in advance, and wherein, in response to the information indicating that the group of sheets is discharged facing downward, the lower-level discharging destination of the discharging destinations is used in advance.

3. The apparatus according to claim 1, wherein the second determining unit determines the order of use of the plurality of discharging destinations depending on whether information, included in the input job, indicates simplex printing or duplex printing, wherein, in response to the information indicates the duplex printing, the upper-level discharging destination of the discharging destinations is used in advance, and wherein, in response to the information indicates the simplex printing, the lower-level discharging destination of the discharging destinations is used in advance.

4. The apparatus according to claim 1, wherein the at least one processor performs switching a discharging destination of the plurality of discharging destinations in response to a number of discharged sheets exceeding a number of sheets dischargeable to the discharging destination based on a result of a sensor for detecting a number of discharged sheets equipped on each discharging destination.

5. The apparatus according to claim 1, further comprising a first selecting unit configured to select a required number of discharging destinations for discharging the sheets, wherein the at least one processor performs a functionality of at least one of the first determining unit, the second determining unit, and the first selecting unit, and wherein the first selecting unit selects the required number of discharging destinations nearly located to each other.

6. The apparatus according to claim 1, further comprising a second selecting unit configured to select a required number of adjoining discharged destinations, wherein the at least one processor performs a functionality of at least one of the first determining unit, the second determining unit, and the second selecting unit.

7. A method comprising:

determining whether a plurality of discharging destinations is to be used for discharging a group of sheets printed by a printing unit based on an input print job;

determining, in response to determining that the plurality of discharging destinations is to be used, an order of use of the plurality of discharging destinations depending on whether a discharging operation is started from a former page of the group of sheets or a latter page of the group of sheets, wherein determining whether a discharging operation is started includes determining the order of use of the plurality of discharging destinations such that, in response to the discharging operation being started from the latter page of the group of sheets, an upper-level discharging destination of the discharging destinations is used in advance and that, in response to the discharging operation being started from the former page of the group of sheets, a lower-level discharging destination of the discharging destinations is used in advance.

8. A non-transitory computer-readable storage medium storing a computer-executable program causing an apparatus to perform the method of claim 7.

* * * * *